United States Patent [19]

Hadgkiss

[11] 4,161,956

[45] Jul. 24, 1979

[54] CLEANING ARRANGEMENTS FOR TUBES

[76] Inventor: Jared Hadgkiss, 125 Fallowfield, Chesterton, Cambridge, England

[21] Appl. No.: 833,952

[22] Filed: Sep. 16, 1977

[51] Int. Cl.[2] ..... B08B 3/02; B08B 9/04

[52] U.S. Cl. ..... 134/167 C; 15/104.3 SN

[58] Field of Search ..... 134/22 C, 24, 56 R, 134/57 R, 166 C, 167 C, 168 C, 169 C; 15/104.1, 104.16, 104.3 SN

[56] References Cited

U.S. PATENT DOCUMENTS

| | | | |
|---|---|---|---|
| 3,159,861 | 12/1964 | Sarcone | 15/104.3 SN |
| 3,208,460 | 9/1965 | Heinicke | 134/22 C X |
| 3,370,599 | 2/1968 | Ciaccio | 134/167 C |
| 3,658,589 | 4/1972 | Shaddock | 134/168 C X |
| 3,866,679 | 2/1975 | Laky | 134/167 C X |
| 3,901,252 | 8/1975 | Riebe | 134/167 C X |

FOREIGN PATENT DOCUMENTS

| | | | |
|---|---|---|---|
| 158853 | 5/1957 | Sweden | 134/22 C |

*Primary Examiner*—Robert L. Bleutge
*Attorney, Agent, or Firm*—Kemon & Estabrook

[57] ABSTRACT

Apparatus for cleaning the interior of a tube comprises a hose which has a jet producing head at one end thereof and which is connected to a supply of pressurized water at its other end. The hose is wound on a reel which has a drive mechanism, such as a motor for rotating the reel in either direction to wind and unwind hose on the reel. The apparatus also includes a housing within which the jet producing head can be accommodated and from which the head can be ejected.

8 Claims, 7 Drawing Figures

CLEANING ARRANGEMENTS FOR TUBES

This invention relates to the cleaning of the interior of tubes and has particular application to the cleaning of the interior of condenser tubes which are used in power stations.

One known arrangement for cleaning the interior of condenser tubes includes a hose, one end of which is connected to a source of water at high pressure and the other end of which is connected to a jet producing head. The jet producing head comprises a frusto-conical portion and a tubular portion extending axially from the larger diameter end of the frusto-conical portion. The outer diameter of the tubular portion is less than the diameter of the larger diameter end of the frusto-conical portion whereby an annular surface is provided around the end of the tubular portion. This annular surface has a number of apertures spaced angularly thereabout, said apertures extending into the frusto-conical portion and communicating with the interior of the tubular portion. The tubular portion is connected by a suitable coupling means to the hose.

In use the hose is held so that the head is located in the end of a tube which is to be cleaned. Water at a high pressure is fed along the hose to the head and is forced out through the aperture jets. The orientation of the aperture jets is such that the water is forced out in a direction which extends at a small angle to the axis of the hose. When the hose is released the head and hose are propelled along the tube by virtue of water being forced out from the head. The head thus travels to the other end of the tube after which it is pulled back along the tube. As the head is pulled back along the tube, water forced out through the aperture jets strikes the interior of the tube and cleans any dirt therefrom.

When it is required to remove the head from one tube and insert it into another it is necessary to disconnect the head from the source of high pressure water otherwise a user is subjected to a spray of the water. This procedure is time consuming and very inconvenient.

I provide a cleaning arrangement which includes a housing from which the head can be ejected and control means for controlling movement of the head up and down the tube to be cleaned. The present cleaning arrangement enables the jet producing head to be quickly transferred from one tube to another without having to disconnect the source of high pressure water.

According to one aspect of the present invention there is provided a cleaning arrangement for cleaning the interior of a tube or tubes which comprises a hose having at one end thereof a jet producing head, a housing in which said head can be accommodated and from which the head can be ejected along a tube to be cleaned and control means for controlling movement of the head along the tube.

According to another aspect of the present invention there is provided a cleaning arrangement for cleaning the interior of a tube or tubes, comprising a hose having at end thereof a jet producing head, a reel on which said hose is wound, drive means for rotating the reel to either unwind hose therefrom or wind hose onto the reel, a housing in which said head can be accommodated and from which the head can be ejected along a tube to be cleaned, switch means for actuating the drive means to rotate the reel, and means for supplying water under pressure to said hose.

The drive means for said reel may be a hydrostatic motor.

The switch means may be mounted in said housing. The switch means may include a first switch which is actuable by said head to cause said drive means to rotate the reel in one direction, and a second switch which is actuable by a stop carried by said hose to cause said drive means to rotate the reel in the opposite direction. A manually operable third switch may be provided, actuation of which inhibits operation of the drive means.

Preferably the water pressure is pulsed. The water pressure may be derived from oil pressure.

The housing may have a discharge outlet through which water can flow.

The oil pressure for operating the hydrostatic motor and for producing the water pressure may be produced by a common pump.

According to a further aspect of the invention there is provided a coupling member for coupling a threaded cylindrical shaft to a tubular hose said coupling member comprising a tubular member having a first tubular portion which is threaded internally in a first sense, and a second tubular portion extending axially from the first portion, the second portion having an internal diameter less than that of the first portion and being threaded internally in a sense opposite to said first sense, the arrangement being such that the member is screwed onto the hose so that the thread of said first sense engages the exterior of the hose and the shaft is screwed into the second portion so that it extends into the first portion and traps the hose between it and the first tubular portion.

The invention will be described now by way of example only with particular reference to the accompanying drawings. In the drawings.

Figure 3A:
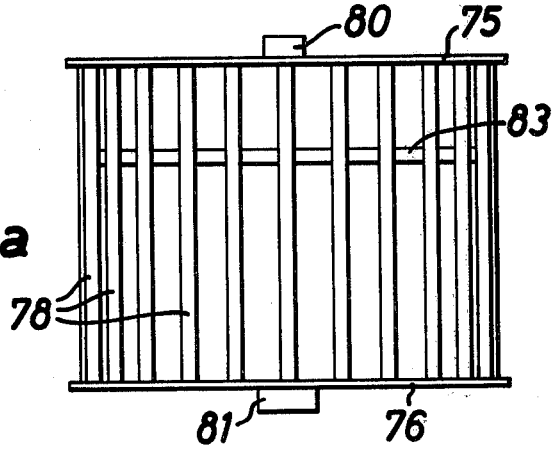
Figure 3B:
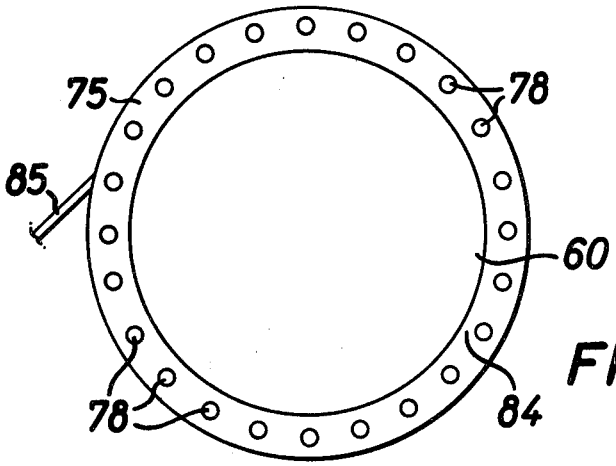
Figure 4:
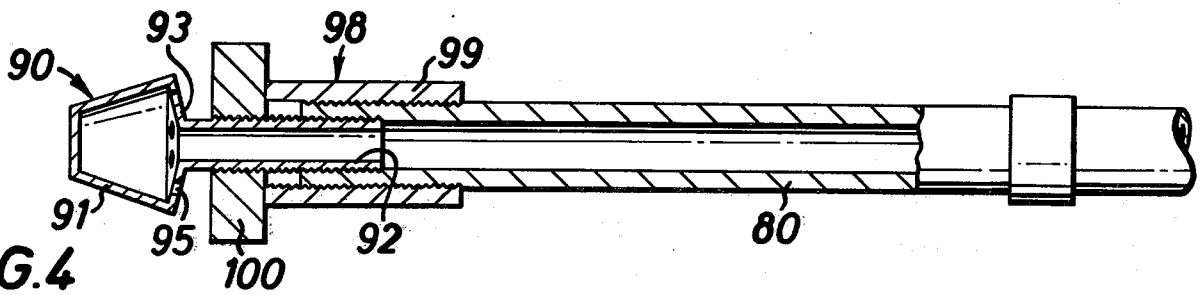
Figure 5:
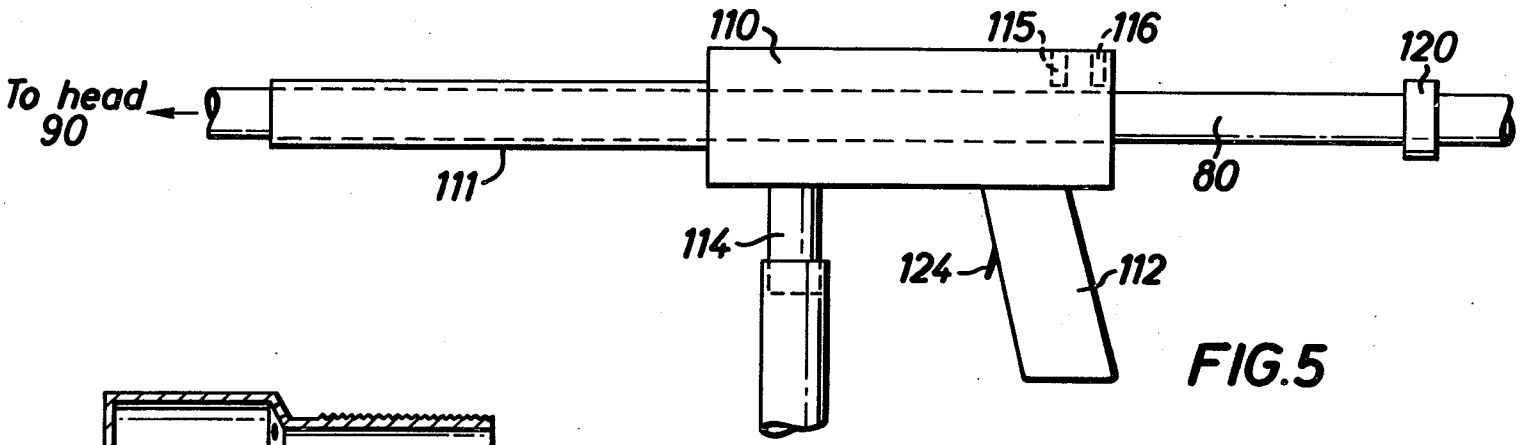

FIGS. 3*a* and 3*b* show another part of the hose carrying reel used in the present cleaning arrangement;

FIG. 4 shows a coupling between a hose and a jet producing head;

FIG. 5 shows a housing from which a jet producing head can be ejected; and

Figure 6:
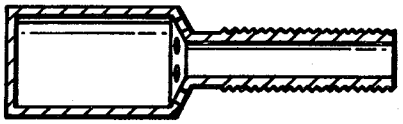

FIG. 6 shows another form of jet producing head.

The present cleaning arrangement has been designed for cleaning the interior of tubes used in the condensers of power stations. Typically a condenser used in a power station has many thousands of tubes which are arranged in closely spaced relationship with their axes horizontal. When cleaning such tubes it is desirable that any cleaning means be easily transferable from one tube to another.

Figure 1:
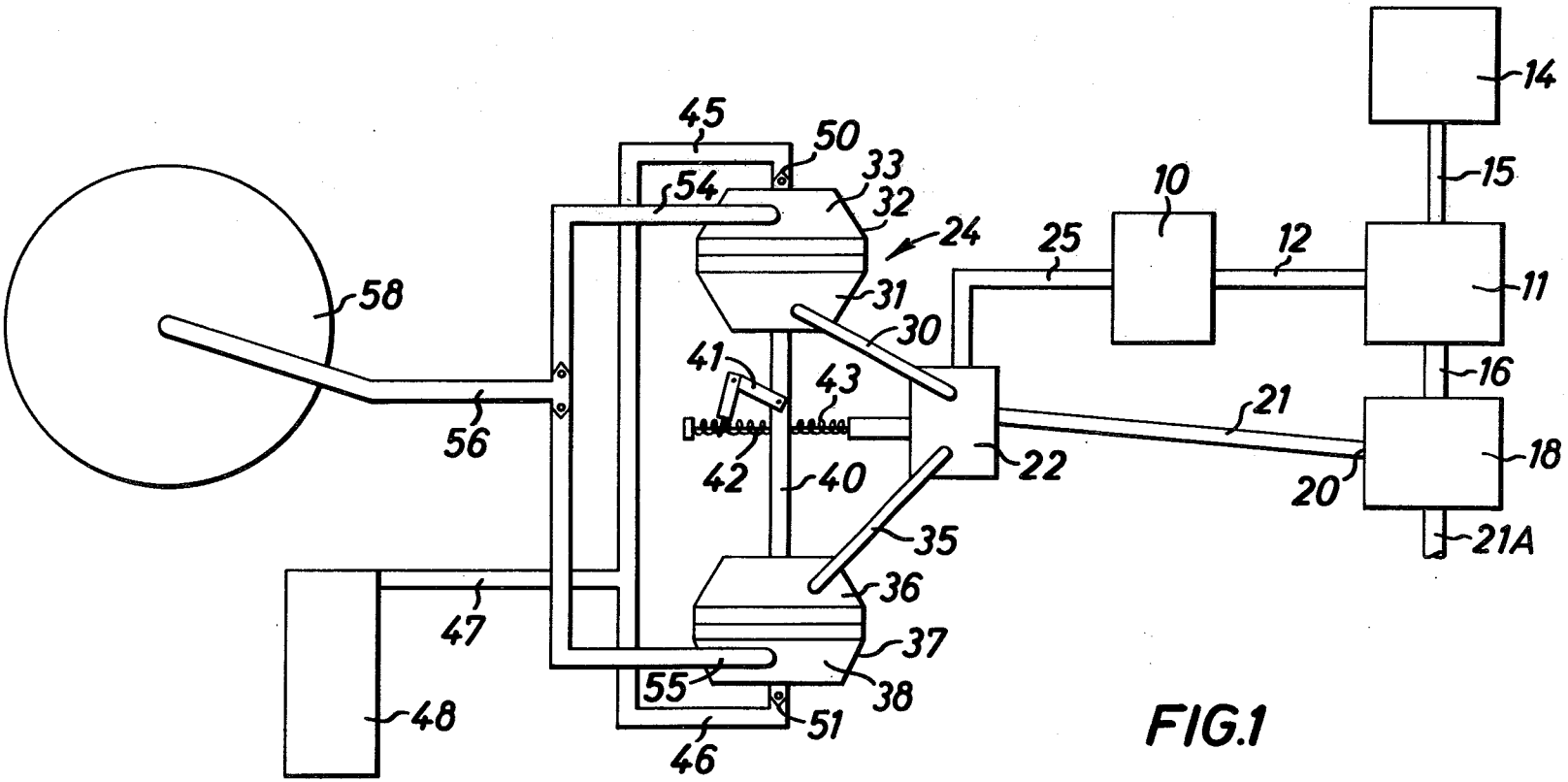
FIG. 1 is a schematic representation of part of a cleaning arrangement in accordance with the present invention.

Referring to FIG. 1 the cleaning arrangement has a tank 10 containing hydraulic oil. The tank 10 is connected to a hydraulic pump 11 by a conduit 12. The pump 11 is a hydraulic, variable stroke, piston swash plate pump and is driven by an electric moter 14 through a drive coupling 15. The hydraulic pump 11 has an outlet which is connected by a conduit 16 to a flow divider 18. The flow divider 18 has a first outlet 20 which is coupled by a conduit 21 and a check valve to a directional flow valve 22 which forms part of a pulsed high pressure water pump 24. The valve 22 has a drain outlet 25 which is coupled to the tank 10. The directional flow valve has a first outlet pipe 30 which is connected to one part 31 of a chamber 32 which is divided into two parts 31 and 33 by a diaphragm. The valve 22 has a second outlet pipe 35 which is connected to one part 36 of another chamber 37 which is also divided into two parts 36 and 38 by a diaphragm. The diaphragms of the two chambers 32 and 37 are linked by a rod 40. The rod 40 is pivotally connected to a bell crank 41 which in turn is coupled to a rod 42 of the valve 22 which rod carries two springs 43.

The parts 33 and 38 of the chambers 32 and 37 each have an inlet conduit 45, 46 the conduits 45 and 46 being in communication with a conduit 47 which is connected to a tank of water 48. A non-return valve 50, 51 is disposed in each conduit 45, 46 at a point where the conduit joins its respective chamber. Each chamber part 33, 38 also has an outlet conduit 54, 55 the two conduits 54, 55 being connected to a common conduit 56 which extends to a hose mounted on a reel 58. The reel 58 will be described in more detail later.

The apparatus described above operates as follows. Oil is drawn from the tank 10 by the motor driven pump 11 and fed into the directional valve 22. From the flow valve 22 the oil is pumped to one or other of the chamber parts 31, 36. When the oil is pumped into one of the chamber parts it displaces the diaphragm of that chamber thereby forcing water out from the other chamber part 33, 38 into a respective conduit 45, 46. When the diaphragm reaches the limit of its travel the valve 22 switches the oil flow to the other chamber so that water is displaced from the other chamber and by means of the rod 40 pulls the first diaphragm back exhausting the oil and drawing in water from the tank 48. Thus it will be seen that the arrangement of the two diaphragm chambers 32, 37 converts hydraulic pressure developed by the pump 11 into pulsed water pressure which is supplied to the conduit 56.

Figure 2:
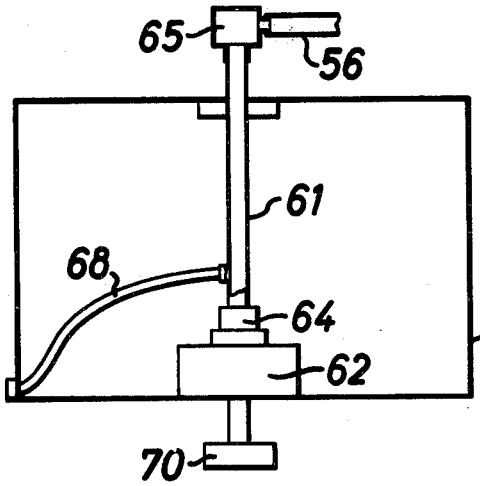
FIG. 2 shows part of a hose carrying reel used in the arrangement of FIG. 1.

Turning now to FIG. 2 and FIG. 3 the hose reel comprises an inner drum 60 which is carried on a stationary vertical shaft 61. A motor 62 is mounted coaxially with the shaft 61 and is coupled to the shaft by a solid coupling 64. The motor is rotatable about the shaft and the drum 60 is arranged to rotate with the motor. The motor 62 is operable by fluid flowing therethrough, the flow of fluid being controlled by a three position, four-way solenoid valve (not shown). The solenoid valve is arranged to receive oil under pressure from the outlet 21A of the flow divider 18.

The shaft 61 is hollow and is connected to the supply of pressurised water via a swivel connection 65 mounted on the upper end of the shaft 61. The swivel connection 65 is connected to the conduit 56.

The hose is wound around the circular periphery of the drum 60 and one end of the hose is connected to the interior of the shaft 61 via a flexible hose portion 68. The lower end of the shaft 61 carries a hydraulic port adaptor 70 which connects the motor 62 to the solenoid valve.

The drum 60 and the hose wound thereon are surrounded by a cage (see FIG. 3) which is stationary. The cage comprises an upper circular plate 75, which is disposed above the upper end of the drum 60, a lower circular plate 76 which is disposed below the lower end of the drum 60, and a plurality of rods 78 extending between the outer peripheral portions of the plate 75 and 76. The spacing between one pair of the rods 78 is made substantially greater than the spacing between the remaining rods to enable one end of the hose to be fed therebetween. Bearings 80, 81 are provided at the top and bottom portions of the cage for supporting the cage on the shaft 61. A circular hose guide 83 is provided and extends around the inner periphery of the ring of rods. The guide is movable vertically relative to the rods and is arranged to be adjacent to the last coil of hose on the drum 60. The guide 83 is movable by a cam on the drum 60.

As can be seen by reference to FIG. **3*b* the rods and drum 60 are so constructed to provide an annular space 84 therebetween within which the hose is located. The motor 62 can be actuated to rotate the drum 60** in either direction. This either unwinds hose from the drum or winds hose onto the drum.

The lower plate 76 of the cage is locked to the shaft of the motor 62. The lock can be released to allow the cage to be rotated about the shaft to locate the point at which the hose leaves the cage at a suitable position.

A length of hose 85 extends from the drum 60 to a position in the vicinity of tubes which are to be cleaned. The free end of the hose has attached thereto a jet producing head 90 (FIG. 4). The jet producing head 90 has a generally frusto-conical portion 91 and a tubular portion 92 extending axially therefrom. The diameter of the larger diameter part of the frusto-conical portion 91 and a tubular portion 92 extending axially therefrom. The diameter of the larger diameter part of the frusto-conical portion 91 is greater than the diameter of the tubular portion 92 thereby defining an annular surface 93 around the end of the portion 92. The annular surface 93 has a number of apertures 95 formed therein the apertures being spaced angularly thereabout. The external surface of the tubular portion 92 is threaded over a substantial part thereof.

The head 90 is connected to the hose by a coupling member 98. The coupling member comprises a first tubular portion 99 and a second tubular portion 100. The internal diameter of the first tubular portion 99 is greater than the internal diameter of the second tubular portion 100. The internal surface of the tubular portion 99 is threaded with a left hand thread which is screwed into the tubular portion 92 of the head. During assembly of the coupling when the head 90 is screwed into the portion 100 the tubular portion 92 of the head extends through into the hose and traps it against the internal surface of the tubular portion 99. Since the thread on the internal surface of the tubular portion 99 is left handed the hose is not screwed out therefrom when the tubular portion 92 is screwed into the tubular portion 100. Thus the head 90 is securely coupled to the hose 80.

The head 90 on the end of the hose is disposed within a housing which is shown in FIG. 5. The housing comprises a tubular housing part 110 within which the head 90 is arranged to be carried. A tubular barrel 111 extends from the housing part 110. The housing has a handle 112 which enables it to be held in a suitable orientation. The housing part 110 has a radially extending port 114 which is connected to a length of flexible pipe. A pair of micro-switches 115, 116 are mounted within the housing part 110 at the rear thereof. The switch 115 is arranged to be closed when the head 90 is contained within the housing part 110 whilst the switch 116 is arranged to be closed when an annular stop 120 carried on the hose 80 enters the housing part 110. The handle 112 carries a further manually operable switch 124. The two micro-switches 115, 116 and the manually operable switch 124 are all connected to the solenoid valve 70.

In use the motor 14 is switched on so that the pulsed high pressure water pump 24 supplies pulses of high pressure water to the conduit 56 and to the hose on the reel 58. At this time the manually operable switch 124 is maintained in a position in which the motor 62 does not operate. Thus the reel 58 cannot unwind. High pressure water is fed to the head 90 via the hose and can drain away through the outlet port 114 and the flexible pipe. The housing is arranged so that the open end of the barrel 111 is disposed adjacent the inlet of the tube which is to be cleaned. The switch 124 is then operated so that the solenoid valve can supply fluid to the motor 62 to rotate the drum 60 whereby the reel 58 unwinds the hose therefrom. Thus the head 90 within the housing part 110 can move forwardly along the barrel 111 and into the tube which is to be cleaned. The movement of the head is caused by high pressure pulsed water, which flows along the hose into the head, leaving the head 90 through the apertures 95. The head travels along to the other end of the tube until the stop 120 enters the housing part 110 and actuates the micro-switch 116. When the micro-switch 116 is actuated the motor 62 is automatically operated to wind the reel 58 in the opposite direction. Thus the head 90 is drawn back along the tube along which it has travelled. As it is drawn back water issuing through the apertures 95 cleans the interior of the tube. The head 90 is drawn back until it enters the housing and actuates the micro-switch 115 at which time the motor 62 reverses so that the head 90 can travel again down the tube. This operation continues until such time as it is required to clean another tube. Then when the head 90 has returned to the housing part 110 the switch 124 is operated to hold the head therein and the device is placed against another tube to be cleaned and the process repeated.

It will be noted by setting the distance between the head 90 and the stop 120 to the length of a tube to be cleaned plus the length of the housing it is possible to accurately set the distance to which the head travels along the tube to be cleaned.

It will be noted that the above arrangement once started automatically controls movement of the head to and fro along the tube. Furthermore the housing containing the head 90 protects a user from the jets of water produced by the head 90. Any water flowing into the housing can drain away through the outlet port 114 and the flexible pipe connected thereto. The use of this housing allows the cleaning head 90 to be moved quickly from one tube to another without it being necessary to switch off the source of high pressure water and without causing an undesirable spray of water.

A further feature to be noted is the fact that as the hose is wound onto or unwound from the reel it is rotated about its axis. This causes the head 90 to rotate as it travels along the tube and ensures through cleaning of the tube.

I have found that the use of pulsed high pressure water gives better cleaning than water under continuous high pressure.

In an alternative arrangement a non-tapered jet producing head can be used as shown in FIG. 6. An advantage of this head is that it is unlikely to become blocked beyond an obstruction in the tube so that it cannot be withdrawn.

The head is also useful in removing blockages which have become sealed by a column of compacted silt on the side of the blockage remote from the head. The head is fired down the tube until it strikes the blockage. The head is then withdrawn by 1 ft to 2 ft so that a partial vacuum is created between the blockage and the head. Atmospheric pressure then breaks up the silt seal and the silt is all drawn past the obstruction so that the obstruction can be pushed out of the tube in the usual manner.

The apparatus can conveniently be mounted on a trailer. The reel for the hose can be mounted on a geometrical arrangement which is hydraulically operable to maintain the axis of the reel vertical. The reel can be raised or lowered by operation of a double acting hydraulic ram. The hydraulic power for the ram can be obtained from the pump 11 via a suitable diverter and twin line check valve.

I claim:

1. Cleaning apparatus for cleaning the interior of a tube or tubes, said apparatus comprising a hose having at one end thereof a jet producing head, a reel on which said hose is wound, drive means for rotating the reel to either unwind hose therefrom or wind hose onto the reel, a hand holdable housing having a barrel in which said head can be accommodated and from which the head can be ejected along a tube to be cleaned, the hose, when said head has been ejected, passing through said barrel, first and second switch means carried by said housing, actuation of said first switch means causing said drive means to rotate the reel in one direction and actuation of said second switch means causing said reel to rotate in the opposite direction, and means for supply water under pressure to said hose.

2. Apparatus as claimed in claim 1 wherein said drive means is a hydrostatic motor.

3. Apparatus as claimed in claim 1 wherein said first switch means is actuable by said head to cause said drive means to rotate the reel in the one direction, and said second switch means is actuable by a stop carried by the hose to cause said drive means to rotate the reel in the opposite direction.

4. Apparatus as claimed in claim 3 including a manually operable third switch, actuation of which inhibits operation of the drive means.

5. Apparatus as claimed in claim 1 wherein the water supply means provides water pressure which is pulsed.

6. Apparatus as claimed in claim 5 wherein the water pressure is derived from oil pressure.

7. Apparatus as claimed in claim 1 wherein said housing has a discharge outlet through which water can flow.

8. Apparatus as claimed in claim 1 wherein said reel comprises a rotatable cylinder arranged with its axis substantially vertical, the hose being coiled around the outer periphery of the cylinder.

* * * * *